US007847746B2

(12) United States Patent
Moser

(10) Patent No.: US 7,847,746 B2
(45) Date of Patent: Dec. 7, 2010

(54) BROADBAND ANTENNA

(75) Inventor: Michael Moser, Hägersten (SE)

(73) Assignee: Sony Ericsson Mobile Communications AB, Lund (SE)

( * ) Notice: Subject to any disclaimer, the term of this patent is extended or adjusted under 35 U.S.C. 154(b) by 208 days.

(21) Appl. No.: 12/167,420

(22) Filed: Jul. 3, 2008

(65) Prior Publication Data

US 2010/0001913 A1 Jan. 7, 2010

(51) Int. Cl.
*H01Q 1/36* (2006.01)
*H01Q 5/00* (2006.01)

(52) U.S. Cl. ..... 343/722; 343/829

(58) Field of Classification Search ..... 343/700 MS, 343/702, 722, 828–830, 846
See application file for complete search history.

(56) References Cited

FOREIGN PATENT DOCUMENTS

| | | | |
|---|---|---|---|
| EP | 1 122 812 | A2 | 8/2001 |
| EP | 1 122 812 | A3 | 8/2001 |
| EP | 1 146 590 | A2 | 10/2001 |
| EP | 1 146 590 | A3 | 10/2001 |
| EP | 1 162 688 | A1 | 12/2001 |
| JP | 2001 177331 | A | 6/2001 |
| JP | 2001 217631 | A | 8/2001 |
| WO | 02/13307 | A1 | 2/2002 |
| WO | 2006/070233 | A1 | 7/2006 |

OTHER PUBLICATIONS

International Search Report, corresponding to PCT/EP2009/050223, mailed May 25, 2009.
Written Opinion of the International Searching Authority, corresponding to PCT/EP2009/050223, mailed May 25, 2009.

*Primary Examiner*—Michael C Wimer
(74) *Attorney, Agent, or Firm*—Renner, Otto, Boisselle & Sklar, LLP

(57) ABSTRACT

The present invention relates to a broadband antenna for at least six frequency bands provided on an isolating antenna support structure comprising. The antenna comprises a low band branch and a high band branch coupled to a substantially rectangular ground plane provided on a PCB. The coupling between the ground plane and the low band branch is a capacitive coupling and has a vertical distance of 3-7 mm there in between.

8 Claims, 3 Drawing Sheets

BROADBAND ANTENNA

TECHNICAL FIELD OF THE INVENTION

The present invention relates to the field of broadband antennas for use with mobile terminal devices, such as mobile phones, PHS phones (Personal Handyphone System) and PDA equipment (Personal Digital Assistant) having communication functions. More particularly, the present invention relates to a broadband antenna for at least six frequency bands.

DESCRIPTION OF RELATED ART

Today there are a number of frequency bands that are used for different mobile terminal devices, such as mobile phones. The transmission and receiving of signals is made according to one or more wireless communication standards. For purpose of illustration, examples of a low frequency wireless communication band include the AMPS frequency band (Advanced Mobile Phone System) and the GSM low frequency band (Global System for Mobile communications). Examples of a high frequency wireless communication band include a GSM high frequency band, a PCS frequency band (Personal Communication Service) and WCDMA frequency bands (Wideband Code Division Multiple Access).

The big variety of frequency bands causes problems if one would like to use one mobile terminal device in different frequency bands. The solution could be to use an antenna of a very broadband type. However, the bandwidth is related to the volume of the antenna and it might therefore be difficult to get enough bandwidth, when the antenna is to be provided in a small volume, for example in a mobile phone. Another solution is to build in a switching function that changes some components or the antenna structure inside the mobile terminal device such that the antenna is tuned to the desired frequency band at the time of use of the frequency band. However, if the mobile terminal device is to access several or all frequency bands simultaneously this solution will not solve the problem.

There are known multi-band antennas capable of receiving and transmitting signals in several frequency bands. They use a broadband antenna that is divided into two branches, one for the low frequencies and one for high frequencies. This type of antenna can be useful for up to 4 or 5 frequency bands.

Thus, there is a need for an antenna that is capable of handling six or more frequency bands in such a way that a mobile terminal device can be used in all the frequency bands simultaneously.

SUMMARY OF THE INVENTION

The present invention is directed towards solving the problem with adapting a broadband antenna to be efficient in at least six frequency bands.

One object of the present invention is to provide a broadband antenna having the capability of being used in six different frequency bands without increasing the volume that is necessary for providing the antenna.

According to a first aspect of the present invention, this object is achieved by a broadband antenna provided on an isolating antenna support structure comprising a PCB and a rod-shaped part. The antenna comprises a low band branch and a high band branch connected to a substantially rectangular ground plane provided on the PCB. The low band branch extends in the same direction as the rod-shaped part and is composed of a rectangle area on an upper portion of the rod-shaped part and an elongated stripe area provided on the upper portion of the rod-shaped part and continues onto a side adjacent thereto. The high band branch is formed on the rod-shaped part as a strip on the upper side and the side adjacent thereto. The rectangle of the low band branch is arranged with a vertical distance to the ground plane of 3-7 mm for creating a capacitive coupling there in between.

According to a second aspect of the invention there is provided a broadband antenna in which the extension of the strip of the low band branch and the high band branch are essentially perpendicular to each other.

According to a third aspect of the invention there is provided a broadband antenna in which the isolating antenna support structure is made of plastic.

According to a fourth aspect of the invention there is provided a broadband antenna in which a shunt inductor is coupled between the ground plane, the high band branch and the low band branch. In a preferred embodiment thereof the shunt inductor comprises a coil having a value of 5-20 nanoHenrys (nH), preferably 15 nH.

According to a fifth aspect of the invention there is provided a broadband antenna, in which the vertical distance between the rectangle of the low band branch and the ground plane is 5 mm.

According to a sixth aspect of the present invention there is provided a broadband antenna, in which the ground plane has a projecting part 22 closest to the rectangle of the low band branch having an area that is essentially the same as the area of the rectangle of the low band branch.

It should be noted that the term "comprises/comprising" when used in this specification is taken to specify the presence of stated features, integers, steps or components, but does not preclude the presence or addition of one or more other features, integers, steps, components or groups thereof.

BRIEF DESCRIPTION OF THE DRAWINGS

The present invention will now be described in more detail in relation to the enclosed drawings, in which.

DETAILED DESCRIPTION OF EMBODIMENTS

Figure 1:
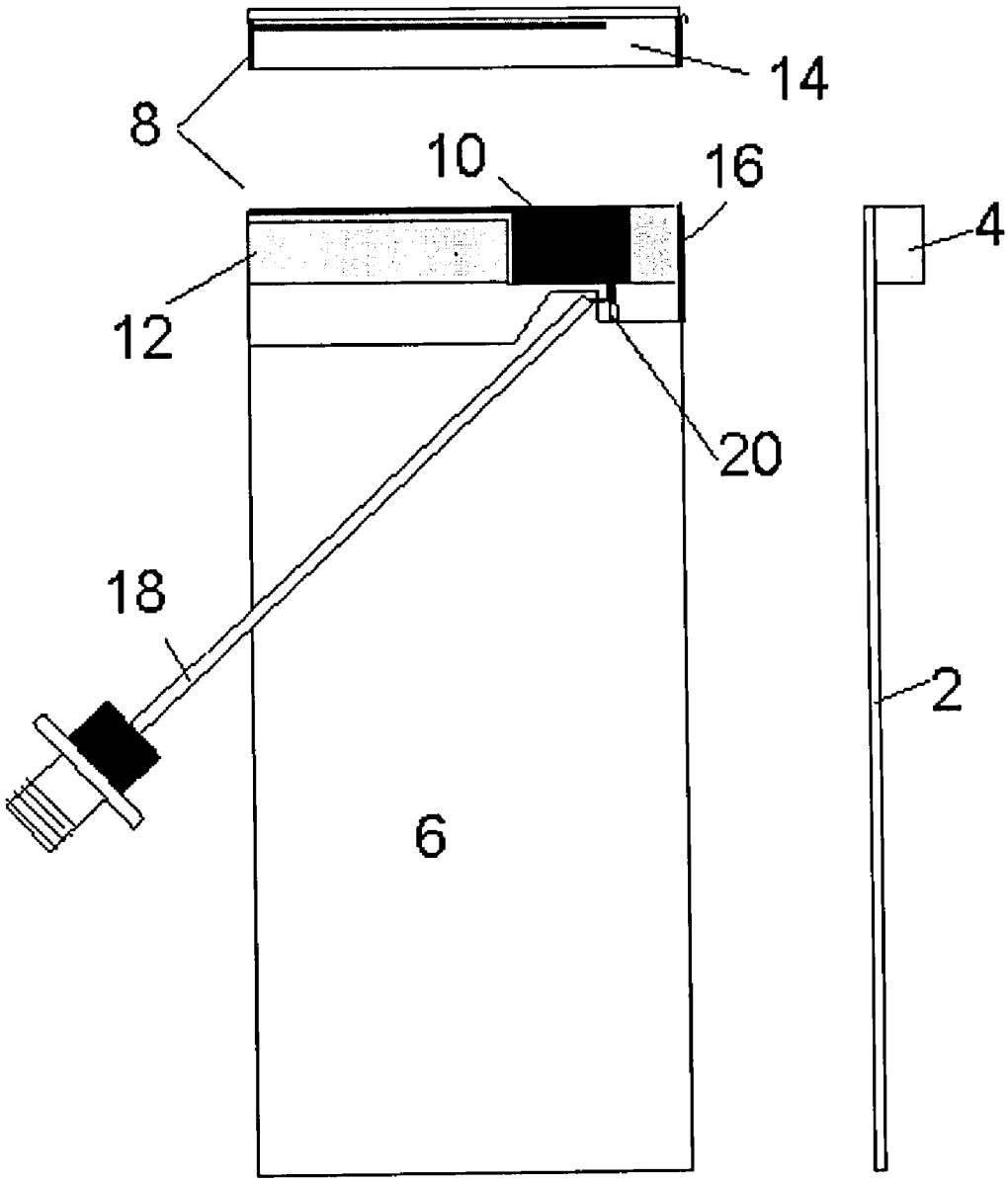
FIG. 1 schematically shows different views of a broadband antenna arranged on an antenna support structure.

A broadband antenna capable of operating in six different frequency bands is depicted in FIG. 1. The broadband antenna is provided on an antenna support structure. The antenna support structure comprises two parts, namely a PCB (Printed Circuit Board) and rod-shaped part 4. The rod-shaped part is arranged on the upper short side of PCB. The size of the antenna support structure may vary, but is preferably kept small, due to the expectations on modern mobile terminal devices. In a preferred embodiment of the present invention the PCB 2 has a size of 45 mm by 100 mm. The rod-shaped part 4 is preferably 5 mm by 8 mm. Thus the antenna support structure only builds 5-6 mm in height depending on the thickness of the PCB 2. The antenna support structure is made of an isolating material, typically same kind of plastic. However, it is obvious to a person skilled in the art that other isolating materials may be used.

On the PCB 4 of the antenna support structure there is provided a ground plane 6, which is made of a conductive material, such as copper or brass. The ground plane covers substantially 80-90% of the area of PCB 2. The space not covered by the ground plate 6 is at the upper part of the PCB 2 and is intended for arranging the rod-shaped part 4 and also for an empty space between the rod-shaped part 4 and the ground plane 6. This empty space is to be described closer below.

On the rod-shaped part 4 a low band branch 8, 10 of the antenna is provided. The low band branch 8, 10 is provided on two sides of the rod-shaped part 4 as is evident from FIG. 1. The low band branch 8, 10 is extending in the direction of the rod-shaped part 4 and is composed of a rectangle-shape 10 and a elongated stripe-shape 8 provided on a upper portion 12 of the rod-shaped part 4. The stripe-shaped part continues onto a side 14 adjacent thereto. The reason for this is to make the low band branch 8, 10 long enough to be tuned in for the low band frequencies.

A high band branch 16 is also provided on the rod-shaped part 4. The direction of the high band branch 16 extends in a direction that preferably is essentially perpendicular to that of the low band branch 8, 10. Also, the high band branch 16 continues onto the side 14 adjacent to the upper side 12. However, it is also possible that the direction of the high band branch has another direction in relation to the low band branch, depending on the design of the rod-shaped part 4.

It should be noted that the rod-shaped part 4 does not need to have a uniform cross section throughout its entire length. It would also be possible to reduce the cross section on the portion where the stripe-shaped part is provided in order to save material.

Both the low and the high band branch are made of a conductive material corresponding to that of the ground plane 6. Both the branches are also feed from the antenna feed 18. Furthermore, there is provided a shunt inductor 20 connected between the ground plane 6 and both the low and high band branch. The shunt inductor 20 is more closely depicted in FIG. 3. The shunt inductor is used to improve the bandwidth of the low band branch. Making a longer PCB 4 and ground plane 6 could also solve the problem, but as mentioned above the present invention is directed towards optimizing antenna while keeping the mobile terminal device as small as possible.

The design of the rectangle area 10 together with the design of an area on the ground plane 6 that is closest to the rectangle area will also improve the overall performance by interacting in such a way that a capacitive coupling is created between the two areas with a value for the impedance versus frequency is stabilized closer to 50 Ohm.

Figure 2:
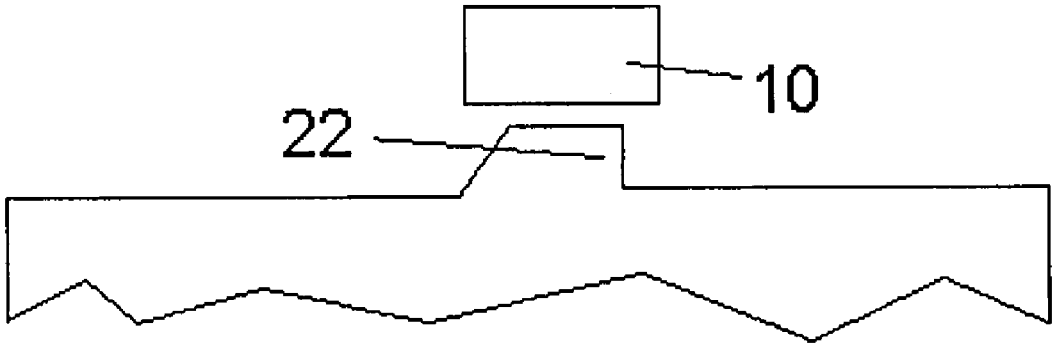
FIG. 2 schematically shows a view of the tuning areas according to the present invention.

The design of the two above mentioned areas is depicted in FIG. 2. FIG. 2 is simplified in order to show the key features of the present invention. Thus, only the rectangle 10 of the low band branch is shown, together with the upper part of the ground plane 6 that is turned towards the rod-shaped part 4. The ground plane 6 has a part 22, which projects outside its ordinary side line. The area of the part 22 corresponds essentially to the area of the rectangle 10. Preferably, the area is slightly smaller and may be designed in a number of ways. The purpose of the design of the areas is to create a capacitive coupling that enhances the high band branch performance. One important factor of making the capacitive coupling work is to secure that there is a vertical distance of 3-7 mm between the rectangle 10 and the projecting part 22. In a preferred embodiment of the present invention a vertical distance of 5 mm has proven to be effective in creating a stable capacitive coupling.

Figure 3:
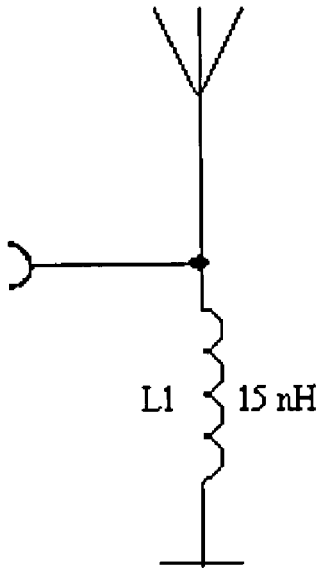
FIG. 3 shows a shunt inductor according to the present invention.

FIG. 3 shows the shunt inductor described above. In a preferred embodiment the shunt inductor comprises a coil L1, which has a value of 5-20 nH, preferably 15 nH. The use of the shunt inductor increases the performance of the low band branch, which is best seen in FIG. 4.

Figure 4:
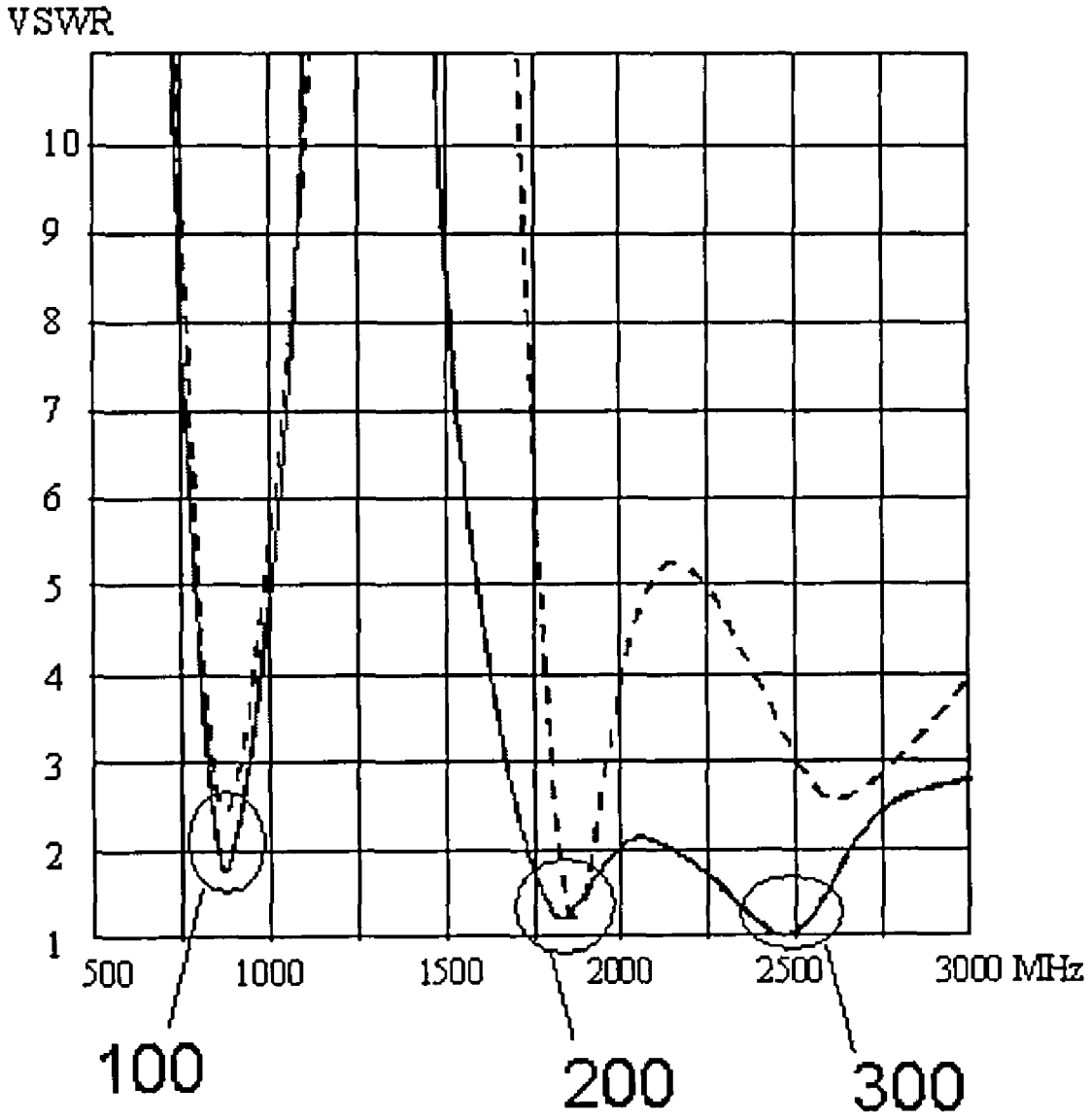
FIG. 4 shows a diagram of the voltage standing wave ratio for the antenna according to the present invention.

FIG. 4 shows a diagram of the voltage standing wave ratio VSWR) at different frequencies. In the example shown in FIG. 4 the broadband antenna is tuned in for operating at six different frequency bands. The frequency bands in the example are an AMPS frequency band at 850 MHz, a GSM low band frequency at 900 MHz, a GSM high frequency band at 1800 MHz, a PCS frequency band at 1900 MHz and two WCDMA frequency bands at 1920-2170 MHz and 2500-2690 MHz respectively. This implies that the antenna must cover 824 to 960 MHz and 1710 to 2690 MHz.

As is evident from FIG. 4, two curves are shown, one with a dashed line showing the performance of the antenna without a shunt inductor and a capacitive coupling and one with solid line that shows the performance for an antenna according to one embodiment of the present invention. A first peak around is shown at 100 and covers the two low frequency bands mentioned above. As is evident from the figure the use of a shunt inductor reduces the VSWR from about 2, 5 to around 1, 8.

A second peak is shown at 200 and covers the high GSM frequency band and the PCS frequency band. A third peak covers the both WCDMA frequency bands. Also the high frequency bands are improved by the use of the capacitive coupling according to the present invention.

Thus, a broadband antenna according to the present invention has been described. It shall also be understood that even if the present invention has been described with preferred embodiments having certain features it is obvious to a person skilled in the art that individual features in one embodiment could be combined with other embodiments or other individual features in other embodiments. Thus, the present invention is best defined by the appended claims.

The invention claimed is:

1. A broadband antenna for at least six frequency bands provided on an isolating antenna support structure comprising a PCB and a rod-shaped part, said antenna comprises a low band branch and a high band branch connected to a substantially rectangular ground plane provided on the PCB, said low band branch is extending in the direction of the rod-shaped part and is composed of a rectangle area on an upper portion of the rod-shaped part and an elongated stripe area provided on the upper portion of the rod-shaped part, which stripe continues onto a side adjacent thereto, said high band branch is formed on the rod-shaped part as a strip on the upper side and the side adjacent thereto, said rectangle of the low band branch is arranged with a vertical distance to the ground plane of 4-7 mm for creating a capacitive coupling there in between.

2. The broadband antenna, according to claim 1, in which the extension of the strip of the low band branch and the high band branch are essentially perpendicular to each other.

3. The broadband antenna according to claim 1, in which the isolating antenna support structure is made of plastic.

4. The broadband antenna according to claim 1, in which a shunt inductor is coupled between the ground plane, the high band branch and the low band branch.

5. The broadband antenna according to claim 4, wherein the shunt inductor comprises a coil having a value of 5-20 nH, preferably 15 nH.

6. The broadband antenna according to claim 1, in which the vertical distance between the rectangle of the low band branch and the ground plane is 5 mm.

7. The broadband antenna according to claim 1, in which the ground plane has a projecting part (22) closest to the rectangle of the low band branch.

8. The broadband antenna according to claim 7, in which the projecting part (22) has an area that is essentially the same as the area of the rectangle of the low band branch.

* * * * *